United States Patent [19]

Barron

[11] 4,094,509

[45] June 13, 1978

[54] FOOTBALL GAME

[75] Inventor: William F. Barron, Ticonderoga, N.Y.

[73] Assignee: The Raymond Lee Organization, Inc., New York, N.Y. ; a part interest

[21] Appl. No.: 766,866

[22] Filed: Feb. 9, 1977

[51] Int. Cl.[2] ..... A63F 3/00

[52] U.S. Cl. ..... 273/247

[58] Field of Search ..... 273/94 R, 134 CF, 93 R, 273/134 D, 134 DB, 135 AA, 145 B

[56] References Cited

U.S. PATENT DOCUMENTS

| | | | |
|---|---|---|---|
| 993,392 | 5/1911 | Miller | 273/145 B |
| 1,138,678 | 5/1915 | McNair | 273/94 R |
| 1,526,092 | 2/1925 | Robertson | 273/94 R |
| 1,552,630 | 9/1925 | Michaelian | 273/94 R |
| 1,569,688 | 1/1926 | Utter | 273/145 B |
| 1,577,932 | 3/1926 | Palese | 273/94 R |
| 2,049,284 | 7/1936 | Anderson | 273/94 R |
| 3,554,548 | 1/1971 | Isom | 273/94 R |
| 3,947,039 | 3/1976 | Sadler et al. | 273/134 CF |

*Primary Examiner*—Richard C. Pinkham
*Assistant Examiner*—Harry G. Strappello
*Attorney, Agent, or Firm*—Daniel Jay Tick

[57] ABSTRACT

A gameboard provides a miniature football field having a plurality of spaced parallel yard lines and side lines. A plurality of peg holes are provided down the center of the playing field and along one of the side lines, holes being provided at each yard line. A football shaped peg of a first color, a football shaped peg of a second different color and a plurality of pegs of a third different color are adapted to removably fit in the peg holes. A dice box extends perpendicularly from one end of the gameboard and has a chute formed therein and opening at the surface of the gameboard. A plurality of dice of the first color and a plurality of dice of the second color are provided. A plurality of play cards indicate various offensive plays and all types of playing variations which occur in a football game whereby a player rolls a predetermined number of the dice of one of the colors into the chute of the dice box via the opening thereof to determine a yardage gain or loss after referring to a play card to determine his play. The player places the football peg on the correct yard line in the center of the playing field and the side line peg on the same yard line as the football peg to mark the line of scrimmage before the next play is called.

1 Claim, 5 Drawing Figures

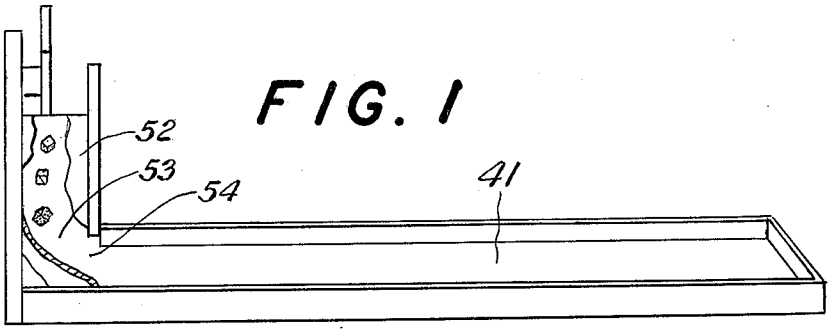
FIG. 1
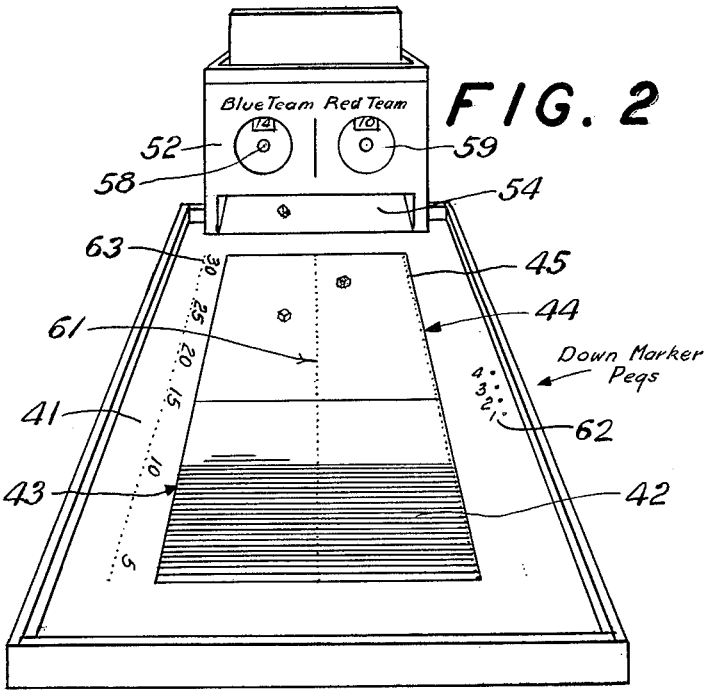
FIG. 2
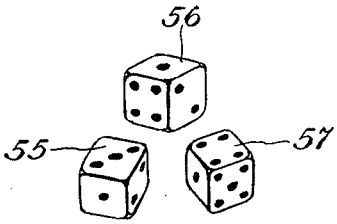
FIG. 3
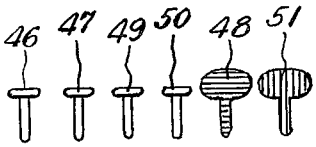
FIG. 4
Football Play Card
| | KICK OFF | RET | ON SIDE | PUNT | RET | | | | | | | | | | PEN | | | | | |
|---|---|---|---|---|---|---|---|---|---|---|---|---|---|---|---|---|---|---|---|---|
| 3 | 1 | TD | G25 | D1 | | | | | | | | | | | | | | | | |
| 4 | 1 | 80 | G20 | D3 | | | | | | | | | | | | | | | | |
| 5 | EZ | 40 | PEN | 60 | | | | | | | | | | | | | | | | |
| 6 | 3 | P35 | B20 | B-1E | | | | | | | | | | | H+10 | | | | | |
| 7 | 5 | 15 | PEN | 42 | | | | | | | | | | | | | | | | |
| 8 | Q-B | 20 | B15 | 28 | | | | | | | | | | | | | | | | |
| 9 | EZ | F+16 | G13 | | | | | | | | | | | | | | | | | |
| 10 | 4 | 18 | B15 | | | | | | | | | | | | | | | | | |
| 11 | 6 | 23 | B14 | | P+12 | | | | | | | | | | | | | | | |
| 12 | 8 | 15 | B12 | | | | | | | | | | | | | | | | | |
| 13 | 2 | 35 | G15 | | | | | | | | | | | | | | | | | |
| 14 | 4 | 17 | B11 | | | | | | | | | | | | | | | | | |
| 15 | 10 | 21 | B18 | | F-F/c | | | | | | | | | | | | | | | |
| 16 | OEZ | F+46 | PEN | | | | | | | | | | | | | | | | | |
| 17 | 1 | 65 | G20 | | | | | | | | | | | | | | | | | |
| 18 | 1 | TD | G25 | | | | | | | | | | | | | | | | | |
| | | | | | | | | | | | | | | | | | | | | |
60
FIG. 5

FOOTBALL GAME

BACKGROUND OF THE INVENTION

The present invention relates to a football game.

Objects of the invention are to provide a football game of simple structure, which is inexpensive in manufacture, is considerably easier to play than most miniature sports games of known type, and provides enjoyment, interest, amusement, and recreation for the players and onlookers, alike.

BRIEF DESCRIPTION OF THE DRAWINGS

In order that the invention may be readily carried into effect, it will now be described with reference to the accompanying drawings, wherein:

FIG. 1 is a partly cutaway, partly sectional view of an embodiment of the gameboard of the football game of the invention;

FIG. 2 is a perspective view from a top, forward point, of the embodiment of the gameboard of FIG. 1;

FIG. 3 is a perspective view of one set of the two sets of dice of the football game of the invention;

FIG. 4 is a view of the pegs of the football game of the invention; and

FIG. 5 is a view of a football play card of the football game of the invention.

DETAILED DESCRIPTION OF THE INVENTION

The football game of the invention comprises a gameboard 41 providing a miniature football field having a plurality of spaced parallel yard lines 42 and side lines 43 and 44, and a plurality of peg holes 45 along the side line 44 and down the center 61 (FIG. 2). Two of the peg holes 45 are provided on each yard line 42 along the side line 44 and down the center of the playing field 61. Each five yard progression on the field is preferably a different color so that it may be more readily and accurately counted off for yardage. Thus, for example, the first, second, third and fourth yard lines are black, the fifth yard line is yellow, the sixth, seventh, eighth, and ninth yard lines are black, the tenth yard line is yellow, and so on.

One peg 48 of a first color such as, for example, blue, is provided as a football peg, as shown in FIG. 4. One peg 51 of a second different color such as, for example, red, is provided as a football peg, as shown in FIG. 4. The pegs 46, 47, 49 and 50 of a third different color such as, for example, orange, are adapted to removably fit in the peg holes 45 on the side line 44, the down marker 62 and the play clock 63. Each of the pegs 48 and 51 has a miniature football shaped at its head. The peg 49 is used to indicate the initial line of scrimmage on a first down. The peg 50 is used to indicate the down line ten yards ahead, indicating the required yardage necessary to make another first down. The first peg, on the initial line of scrimmage, moves along with the peg having the miniature football on it, although following a play, the ball peg and the first peg could be located on different yard lines.

A dice box 52 (FIGS. 1 and 2) extends substantially perpendicularly from one end of the gameboard 41 and has a chute 53 (FIG. 1) formed therein and opening at the surface of the gameboard 41 via an opening 54 (FIGS. 1 and 2).

Three dice 55, 56 and 57 of the first color, such as, for example, blue, are provided, as shown in FIG. 3. An additional three dice of the second color such as, for example, red, are provided, but are not shown in the FIGS.

A plurality of play cards of the type shown in FIG. 5 are provided. The play cards indicate various offensive plays and all types of playing variations which occur in a football game.

A pair of scoring wheels 58 and 59 (FIG. 2) are provided on the dice box 52 facing the field 41. The scoring wheel 58 is of the first color such as, for example, blue and the scoring wheel 59 is of the second color such as, for example, red.

A player rolls his or her three dice of his or her color into the chute 53 of the dice box 52 via the opening 54 thereof to determine a yardage gain or loss, after referring to a play card 60, of the type shown in FIG. 5, to determine his or her play.

RULES OF PLAY

1. Each player selects his set of dice for the game.

2. Each player then separately rolls his three dice into the dice box with the player getting the highest total having the option of kicking off or receiving the kickoff to begin the game. Whichever player kicks off to begin the game, that player receives the kickoff to begin the second half of the game.

3. Each quarter of the game constitutes 30 plays. However, any and all kickoffs do not count as a play to be marked off on the counter.

4. Before beginning play of the game, the players may decide as to whether they want to end the game upon the completion of four quarters, or proceed into a "sudden death" overtime of one quarter in the event the score is tied at the end of regulation play. If the contest goes into "sudden death" overtime, and neither teams scores any points, a safety, field goal or touchdown, within the 30 plays, the game then ends in a tie.

5. All three dice must enter the dice box and come to rest on the playing surface to be a valid roll. In the event not all three dice enter the dice box, or any should bounce off the playing field, or there should be a cocked die, the turn is taken over, tossing all three dice again. An invalid toss of the dice does not count as a play.

6. As the players sit on each side of the playing field, each one is responsible for moving the following markers. The player sitting on the same side of the field where the plays are counted off is responsible for moving that peg after the completion of each play from scrimmage. Any play called back because of a penalty is still counted off as a play. Remember, the peg is not moved on the kickoffs. The player on the opposite side of the field is responsible for moving the peg showing the current down of the offensive team as well as moving the sideline peg in line with the position of the football peg in the center of the field. It should be noted again, at this time, that this sideline peg should not be moved at the same time that the football peg is moved in the event that a penalty may be involved. This sideline peg is moved only after the play has been completed without any need of reference to the line of scrimmage from which the play began. In the event a first down is made, both sideline pegs are moved accordingly, the first peg on the same yard line as the ball and the second peg 10 yards ahead showing the distance required to gain another first down.

7. The football peg in the center of the field is moved by the player in possession of the ball.

8. The Play Cards refer to numbers from 3 to 18 inclusive. The player adds the total number showing on his three dice and then refers to the Play Cards showing the results of that play.

9. With the kickoff, both players will then turn their attention to the Play Cards which will show the results of their tossing of the dice.

10. With the exception of kickoffs the offensive player must announce in advance to tossing his dice as to what play he is calling. Once the dice are in the air the play called cannot be changed.

11. An exception of the kickoff situation is the "onside" kick. If the player kicking off desires to attempt an "onside" kick in an effort to regain possession of the ball, he must announce this fact in advance to tossing the dice.

12. The offensive player has five running plays and three passing plays to choose from, in addition to field goal attempts.

13. If the offensive player elects to punt the ball away on any down other than the fourth down, it is to be considered as a "quick kick" in an effort to catch the defense in a surprise move. Whenever the offense makes such a move, punting or "quick kicking" on downs one, two, or three, add 15 yards to the total of punting yards shown on the Playing Cards. This play, of course, will as any other play, be announced in advance to tossing the dice.

14. Wherever the letters "T-D" appears it is a touchdown, scored from that point on the field.

INTERPRETATION OF THE PLAY CARDS

1. On various plays on the Playing Cards some of the results are preceded by the following letters: "F" equals Fumble and "P" equals Penalty. Following the letter will either be numbers, a plus, a minus, or a zero.

2. Fumble 13 After determining the gain or loss of a play involving a fumble, the player in possession of the ball will toss the dice to determine which team recovers the fumble. After adding up the total of the three dice, refer to the Playing Cards in the column under the heading of "Fumble." The letter "O" signifies the offensive team has recovered the fumble, while the letter "D" indicates the defense has recovered the fumble. Once recovery of the fumble has been established that team may attempt to advance with the ball by again tossing his dice and referring to the column with a heading "Fumble Run."

3. Penalty— Whenever a penalty is involved in a play, that play must be completed before determining on which team the penalty is against. It is to be noted here, again, that the sideline peg marking the current line of scrimmage should not be moved until the outcome of the penalty is known and a final determination of the play is made. The player in possession of the ball tosses his dice, adds the total of the dice and refers to the Penalty Column. Penalties preceded by a plus are in favor of the offensive team. Those preceded by a minus are against the offensive team. Whichever team the penalty is in favor of then decides whether to take the penalty or accept the result of the play, whichever he feels is more beneficial. Any penalities involved when a player is running with the ball, such as the return of kickoffs and punts, field goal run back, fumble run, pass interception run, or any pass completion run is always a 15 yard penalty, once the plus or minus factor has been determined. Refer to No. 6 under penalty, H plus 10 equals defensive holding. This is a 10 yard penalty in favor of the offensive team. If any penalty occurring at the line of scrimmage is taken instead of the play, the down remains the same.

4. Kickoff— The numbers in the column indicate the yard line at which the kickoff is caught. The letters "E-Z" means the ball has gone into the end zone and the receiving team has the option of running it out of the end zone or downing the ball and placing it on the 20 yard line (See numbers five and nine). The letters "O-E-Z" means the ball has been kicked out of the end zone with no run back possible. The ball is then placed at the 20 yard line (See No. 16). The letters "O-B" means the kickoff went out of bounds before reaching the end zone. The kickoff is attempted again following a five yard penalty against the kicking team. If the next kickoff remains in play, add five yards to the figure shown in the "Kickoff Column" for the point of receiving the ball. Example: No. 10 shows the kickoff being caught at the four yard line. Add five to this because of the penalty, with the result being that the ball is caught at the nine yard line. The only exception to this rule is that numbers 5, 9 and 16, where the ball enters the end zone, does not change. It is, of course, possible that a second kickoff attempt may go out of bounds again, resulting in another 5 yard penalty for the kicking team. This would mean adding 10 yards to the figure shown in the "Kickoff Column."

5. Kickoff Return— The numbers represented in the column refer to the number of yards the ball is returned from the spot of receiving it. Numbers 9 and 16 show advance of the ball with a fumble. After marking off the return run yardage the offensive player tosses his dice again to determine recovery of the fumble. No. 6 shows a 35 yard return, but with a penalty. After marking off the yardage the offensive player tosses his dice again to determine which team the penalty is against. Since the penalty takes place while a player is running with the ball, as described in the subject of penalty, it is a 15 yard penalty.

6. Onside Kick— The numbers in this column indicate the yards the ball is kicked from the 35 yard line for Pro games; 40 yard line for other games. If the number is preceded by a "G" the kicking team recovers the ball at that point. If the number is preceded by the letter "B" the ball is recovered by the receiving team. Where the letters of "PEN" appear, the onside kick did not travel the necessary 10 yards. Therefore, the kicking team is penalized five yards and must kick again. The kicking team has the option of attempting another "onside" kick, which must be announced in advance, or the player may declare the onside kick as being cancelled and he is returning to the normal kickoff.

7. Punt— A punt by the offensive team usually takes place on the fourth and final down in a series of plays during which the offensive team was unable to make another first down (See rule No. 13 under "Rules of Play" concerning "Quick Kick"). The numbers shown in this column indicate the yards punted from the line of scrimmage with the following exceptions. Numbers 3, 4, 13, 17 and 18 will show the letter "D" followed by a number. This means that on this punt the ball has been "downed" at that yard line of the receiving team. No. 6 shows the No. 12 preceded by the letter "B" which means the punt was blocked with the ball loose 12 yards behind the line of scrimmage. Since it is a loose ball the offensive player tosses the dice again to determine which team picks up the loose ball by referring to the Fumble Column. The player recovering the blocked punt tosses the dice to determine how far he advances the ball after picking it up by referring to the "Fumble Run" Column. Numbers 10 and 15 show the number preceded by a "P" indicating there is a penalty on that play. The play, including the return of the punt, must be completed before determining on which team the penalty is against. When the play has been completed, the offensive player tosses his dice and then refers to the Penalty Column. Whichever team the penalty is in favor of has the option of taking the penalty or the play, whichever would be beneficial to that player. Number 16 shows a loss of 17 yards on the attempted punt as the result of a bad pass from the center.

8. Punt Return— The numbers indicated in this column show the yardage the punt is returned from the point of reception. Number 12 shows the letters "F-C" indicating a fair catch with no advance. Number 15 also shows "F-C" but with a fumble. Number 9 shows an advance of 20 yards with a fumble. The team receiving the ball is to be considered the offensive team in determining the recovery of the fumble. The player returning the punt will toss his dice. Number 11 shows an advance of 12 yards with a penalty. The team receiving the ball is now considered the offensive team. The player receiving the punt will toss his dice to determine on which team the penalty is against. Since this is an action play, the penalty is for 15 yards and the player tossing the dice will be looking for a plus in the "Penalty Column."

9. Kicking Point After Touchdown— In this column the letter "G" indicates the extra point is good while the letter "B" indicates the try for the extra point was bad. Numbers 6 and 15 show a "P" meaning a penalty on the play. The player attempting the extra point will toss his dice to determine which team the penalty is against. Referring to No. 6, should the penalty be in the kicking team's favor they would accept the penalty and attempt a second try of the extra point. If the penalty was in favor of the defense, they would accept the play and the kick would be no good. Referring to No. 15, if the penalty was in favor of the defensive team, they would accept the penalty and force the offensive team to try again for the extra point. If the penalty was in favor of the offensive team, they would accept the play and the kick would be good, scoring one point.

10. Run or Pass-Point After Touchdown— This is a two point conversion after a touchdown that can be a run or pass play from the 3-yard line as an option to kicking for a one point conversion in any games not involving professional football teams. The conversion rules are the same as those listed above in Section 9.

11. Field Goals— There are four columns involving field goal attempts. The "FG" Columns are accompanied by the numbers 10, 20, 30 and 40. When attempting to kick a field goal, these numbers mean that if you are trying to kick a field goal from the 10 yard line and in, you would refer to the column heading of "FG" 10. Field Goals attempted between the 11 and 20 yard lines, refer to the next heading, "FG" 20; between the 21 and 30 yard lines, the heading "FG" 30, and from the 31 to 40 yard lines, the heading "FG" 40. Within these four columns are the letters "G", indicating the field goal attempt is good and the letters "B", indicating the attempt is bad. When playing game involving professional teams, and the field goal tried from outside the 20 yard line is bad, the ball is returned to the line of scrimmage from which the attempt was made with the other team taking possession. Example: If the attempt is made from the 33 yard line and the kick is bad, the ball is returned to the 33 yard line with the other team taking possession of the ball. If the field goal is tried between the 20 yard line and the goal line, and the kick is not good, the ball is returned to the 20 yard line and the other team takes possession. In games played not involving professional football teams, a field goal that is not good from any point between the 40 yard line and the goal line is returned to the 20 yard line with the other team taking possession. Where the letters "G" and "B" are preceded by the letter "P", follow the aforementioned procedure in Section 9 concerning penalties, under "Kicking Point After Touchdown." Where it shows the letter "B" followed by a minus number this means the attempted field goal was blocked and the ball recovered that many yards behind the line of scrimmage. If this play takes place on the fourth and final down the defensive team takes possession of the ball at that point. However, should this happen on a first, second or third down play, it will be necessary for the offensive player to toss his dice again to determine who recovers the loose ball by referring to the "Fumble Column". There is no advance of the ball after recovering the blocked field goal attempt. Under the column heading "FG" 40 your attention is called to Numbers 5 and 15 showing the letter "R" followed by a number. This means the field goal kick came down short of the goal line and had to be picked up by the defensive team for a run back. The number indicates the yard line at which the ball was picked up. The defensive player then tosses his dice to determine the yards returned by referring to the column heading "FG" Run. You will note there are fumble and penalty situations in this run back, and they should be handled the same way as described in punt return.

12. Penalty— The player tossing the dice will always be looking for a plus number which means the penalty is in his favor. Number 6 is a 10 yard penalty against the defense for holding.

13. Fumble— The team is possession of the ball when a fumble occurs is to be considered the offensive team for the purpose of determining fumble recovery. That player will toss his dice looking for an "0" meaning that he retains possession of the ball.

14. Fumble Run— Once it has been determined which team has recovered the fumble that player will toss his dice to determine how many yards he has advanced after recovering the fumble. In games not involving professional football teams there is no fumble run.

15. Intercepted Pass Run Back— When a pass has been intercepted by the defensive team, that player will toss his dice to determine the number of yards returned from the point of interception.

16. Running Plays— After the offensive polymer declares which running play he is attempting he tosses his dice and totals up the numbers showing. If a plus appears opposite that number for the running play called, he tosses the dice again and refers to the Plus Column of that particular running play for the yards gained. If a minus appears, the defensive player tosses his dice and then refers to the Minus Column showing the yards lost by the offensive team. In the plus and minus section there are fumbles and penalties. In the case of fumbles follow the aforementioned procedures. Where penalties are involved the number of yards shown in the "Penalty Column" will apply. In both the fumble and penalty situations the entire offensive play, plus or minus, must be completed before the offensive player tosses his dice for any determination of a fumble and penalty situation. Where an "O" appears there is no gain on the play and a second toss of the dice for the Plus or Minus Column is not required.

17. Pass Play— The offensive player has the choice of three passing plays— screen pass, which when completed, is always caught behind the line of scrimmage— the short pass and the long pass, which are both completed beyond the line of scrimmage. The following applies to all three passing plays. If the numbers on the dice tossed total 3 or 18 it is a touchdown. Whenever the letter "C" appears it means a completed pass. The offensive player will toss the dice to determine how many yards from the line of scrimmage the ball is caught, and will then roll once again to find out how much further the pass receiver will advance the ball after the catch. On the screen pass plus all receptions are a number preceded by a minus. This means the screen pass is completed that many yards behind the line of scrimmage. The next column indicates the number of yards the receiver advanced the ball after the catch. The same procedure holds true for the short pass and long pass completion as shown on Playing Cards. On the running plays after a completed pass there are fumbles and penalties. Follow the same procedure already mentioned, but with a reminder that all penalties involving the pass reception run are 15 yards and will be marked off, in one direction or the other, from the final point of the completed pass, which includes the "Pass Run". Continuing with the first section of the Pass Playing Cards, concerning the three types of passes, whenever the letters "INC" appear, the pass is incomplete. The letters "P-INC" means the pass is incomplete, but there was a penalty. The offensive player will toss his dice to determine the penalty using the figures shown in the "Penalty Column." The letters "P-C" mean the pass was completed, but there was a penalty. Before tossing the dice again in referring to the "Penalty Column", the successful pass play must be completed showing total yards gained. The letters "INT" means the pass thrown was intercepted by the defense. To complete this play the offensive player tosses his dice to determine how far the ball was thrown when it was intercepted. The defensive player then tosses his dice to determine the run back of the intercepted pass and will refer to the column headed "Intercepted Pass Run Back." The letters "P-INT" means the pass was intercepted, but there was a penalty on the play. The pass interception play must be completed, including the interception run back, before the offensive player who threw the pass tosses his dice for a determination of the penalty.

Where a minus symbol appears it means the quarterback was tackled behind the line of scrimmage before he was able to throw the ball. In this case the defensive player tosses his dice and refers to the Minus Column of the type of pass attempted to determine the lost yardage on this play. In this category the presence of fumble and penalty situations appear. The procedure for both is the same as in the case mentioned earlier of a pass receiver running with the ball. The offensive player will toss his dice in determining the outcome of the fumble or penalty situation. Any penalties on this play are 15 yards.

18. Scoring of Points—

Touchdown = 6 points

Extra Point Kick = 1 point

Extra Point Run or Pass = 2 points

Field Goal = 3 points

Safety (offensive team tackled in their end zone) = 2 points.

When offensive team gives up 2 points on a safety, they must also give up the ball by kicking off from their 20 yard line. Since the kicking team is kicking off 15 yards further back from the normal kickoff position of the 35 yard line, the receiving team will add 15 yards to the figure shown in the "kickoff column." If the kickoff shows the ball going into or out of the end zone, it will, instead, be received at the 15 yard line. The receiving team player will then toss his dice for yardage of the kickoff return. The "O-B", out of bounds kickoff, still applies, however, and you will follow the rules concerning this situation as described in the explanation of kickoff, Item 4.

While the invention has been described by means of a specific example and in a specific embodiment, I do not wish to be limited thereto, for obvious modifications will occur to those skilled in the art without departing from the spirit and scope of the invention.

I claim:

1. A football game, comprising a gameboard providing a miniature football field having a plurality of spaced parallel yard lines and side lines and a plurality of peg holes down the center of the field and along one of the side lines, holes being provided at each yard line;

a football shaped peg of a first color adapted to removably fit in the peg holes;

a football shaped peg of a second different color adapted to removably fit in the peg holes;

a plurality of pegs of a third different color adapted to removably fit in the peg holes;

a dice box extending substantially perpendicularly from one end of the gameboard and having a chute formed therein and opening at the surface of the gameboard, said dice box having a side facing the field and extending substantially parallel to the yard lines, said dice box having a dimension substantially parallel to said yard lines which is greater than the width of the field and smaller than the width of the gameboard, the opening of the chute being greater than the width of the field;

a plurality of dice of the first color and a plurality of dice of the second color;

a plurality of play cards indicating various offensive plays and all types of playing variations which occur in a football game whereby a player rolls a predetermined number of the dice of one of the colors into the chute of the dice box via the opening thereof to determine a yardage gain or loss after referring to a play card to determine his play, the player placing the football peg on the correct yard line in the center of the field and the side line peg on the same yard line as the football peg to mark the line of scrimmage before the next play is called; and a pair of scoring wheels on the side of the dice box facing the field, each of the scoring wheels being of a corresponding one of the first and second colors.

* * * * *